US008813393B2

(12) United States Patent
Koyess et al.

(10) Patent No.: US 8,813,393 B2
(45) **Date of Patent: *Aug. 26, 2014**

(54) SKATE

(71) Applicant: Sport Maska Inc., Montreal (CA)

(72) Inventors: Philippe Koyess, Lachine (CA); David Dekoos, Montreal (CA); Alexandre Chretien, Laval (CA)

(73) Assignee: Sport Maska Inc., Montreal, Quebec ( * ) Notice: Subject to any disclaimer, the term of this patent is extended or adjusted under 35 U.S.C. 154(b) by 0 days.

This patent is subject to a terminal disclaimer.

(21) Appl. No.: 13/766,234

(22) Filed: Feb. 13, 2013

(65) Prior Publication Data

US 2013/0214499 A1 Aug. 22, 2013

Related U.S. Application Data

(63) Continuation of application No. 12/642,679, filed on Dec. 18, 2009, now Pat. No. 8,387,286.

(60) Provisional application No. 61/139,404, filed on Dec. 19, 2008.

(51) Int. Cl.
*A43B 5/00* (2006.01)

(52) U.S. Cl.
USPC ..... 36/115; 36/45; 36/88

(58) Field of Classification Search
USPC ..... 36/88, 89, 92, 115, 45
See application file for complete search history.

(56) References Cited

U.S. PATENT DOCUMENTS

| | | | | | |
|---|---|---|---|---|---|
| 3,975,840 | A * | 8/1976 | Juzenko | 36/117.1 |
| 5,878,513 | A * | 3/1999 | Annovi et al. | 36/115 |
| 5,913,593 | A * | 6/1999 | Aird et al. | 36/31 |
| 6,102,412 | A * | 8/2000 | Staffaroni | 280/11.225 |
| 6,499,233 | B1 * | 12/2002 | Chenevert | 36/55 |
| 6,871,424 | B2 * | 3/2005 | Labonte et al. | 36/115 |
| 7,140,127 | B2 * | 11/2006 | Yang | 36/45 |
| 7,316,083 | B2 * | 1/2008 | LaBonte | 36/115 |
| 7,533,479 | B2 * | 5/2009 | LaBonte | 36/115 |
| 7,716,854 | B2 * | 5/2010 | Roux et al. | 36/50.5 |
| 8,387,286 | B2 * | 3/2013 | Koyess et al. | 36/115 |
| 2004/0016150 | A1 * | 1/2004 | Labonte et al. | 36/115 |
| 2004/0200099 | A1 * | 10/2004 | Chenevert | 36/114 |
| 2005/0210709 | A1 * | 9/2005 | Labonte | 36/89 |
| 2011/0016752 | A1 * | 1/2011 | Koyess et al. | 36/115 |

* cited by examiner

*Primary Examiner* — Marie Bays
(74) *Attorney, Agent, or Firm* — Norton Rose Fulbright Canada

(57) ABSTRACT

A skate having a skate boot with a non-lasted boot shell, the shell having a first non-lasted three-dimensional sub-shell and a second non-lasted three-dimensional sub-shell, the second sub-shell being interior to and adjoining the first sub-shell, the first sub-shell comprising a first material having a first density and the second sub-shell comprising a second material having a second density, the second density being less than the first density, the shell being shaped so as to have a heel portion, an ankle portion, a lateral portion, a medial portion, and a sole portion; and a ground-engaging assembly disposed on an underside of the skate. Additional sub-shells are possible. Methods of manufacturing the skate boot shell, including molding and build-up, are also disclosed.

27 Claims, 5 Drawing Sheets

SKATE

CROSS-REFERENCE TO RELATED APPLICATIONS

The present application is a continuation of U.S. patent application Ser. No. 12/642,679, filed Dec. 18, 2009, which claims benefit of U.S. Provisional Patent Application No. 61/139,404, filed Dec. 19, 2008, the entire contents of both of which are incorporated by reference herein.

FIELD OF THE INVENTION

The present invention relates to skates, and particularly (although not exclusively) to ice skates.

BACKGROUND OF THE INVENTION

Skates are a type of footwear commonly used in may athletic activities such as ice skating, ice hockey, inline roller skating, inline roller hockey, etc. A skate typically has a skate boot and a ground-engaging skate element such as a blade or a set of inline rollers attached to the underside of the boot permitting movement of the skate (and its wearer) across an appropriate surface. The skate boot typically covers all of the foot and part of the leg of a wearer.

Skates have been around for some time and are well known in the art. While in some ways similar to other footwear, they have their own unique design characteristics owing to the use to which they are put. Skating is not the same as walking, hiking, skiing, etc. Thus, for example, skates should be comfortable to wear while skating (especially during hockey play in the case of hockey skates), provide good control while skating (especially during hockey play in the case of hockey skates), and have a relatively long lifetime (as compared with some other types of footwear). The comfort and control provided by a skate depend on many factors including the hardness of the skate boot, the flexibility in the ankle in the area of the skate boot, the overall flexibility of the skate, the conformity of the skate boot to the foot of a wearer, and the weight of the skate. A skate boot's resistance to cuts, ruptures and impacts is also important because it contributes to the safety of the user and the useful lifetime of the skate. A skate's useful lifetime also depends on resistance to cyclic stresses and forces applied to the skate while skating.

Conventionally there are two different kinds of skates, which are separated according to the manner in which their skate boots are constructed. The more traditional of these is the "lasted" skate boot, while the other is the "non-lasted" skate boot (sometimes referred to as "molded" skate boots—although lasted skate boots may have components that were molded—and although there are other non-lasted methods of manufacturing besides molding). Each of these types of boots will be discussed in turn.

The "lasted" skate boot is made in a manner similar to traditional shoe making techniques. As the name would suggest, a last (i.e. a, traditionally wooden, model of a foot used for making shoes or boots) or other similar form is used in the Manufacture of this type of boot. The process of making a lasted boot starts with preparing the various materials from which the boot is to be made. This traditionally involves cutting out various shapes and forms from various layers of material (which might be leathers, synthetic fabrics, natural fabrics, foams, plastics, etc.) necessary to form the completed boot. These various shapes and forms are then superimposed on the last (usually one by one), worked to form the appropriate foot shape and secured together via any appropriate method (e.g. stitching, gluing, tacking, etc.).

While this traditional method has been employed for some time, and is still in wide use today, lasted skate boots have their disadvantages, most of which are well known in the art. Among them are the following: Given the number of actions and manipulations that are required, the manufacture of a lasted skate boot tends to be very labour intensive, and therefore more costly than non-lasted manufacturing techniques, meaning that lasted boots can be expensive to manufacture. Further, lasted skate boots tend to conform less well to the foot of a wearer given that a last merely approximates the three dimensional shape of a human foot, and that, in any event, the boots tend not to be of the exact shape of the last. Also, as the skate boot is made generally from layers of flat materials that are bent on the last to form the three-dimensional shape of the boot, after bending, these materials can in some instances contain stresses within them that may lead to the skate boot being more easily damaged. Further, lasted skate boots have a relatively long "break in time", i.e. a period of time for which a wearer must wear the skates to break them in to get the skate boots to more comfortably conform to and fit the wearer's foot. Finally, lasted skate boots produced in this manner are not identical to one another (despite the use of the same last) since they are each individually made by hand. Their quality depends (at least in part) on the skill and craftsmanship of the person who put them together.

For these reasons, skate manufacturers have made attempts over the years at improving lasted skate boots. For instance, some have attempted to simplify the manufacturing process by reducing the number of layers of materials of which the boot is made, by adding in various molded plastic shells (usually in place of other materials), by making a flat "sandwich" of the layers of material of which the boot is to be made before putting the materials on the last and then bending the entire sandwich around the last. Some of these have been more successful than others.

The other predominant type of boot is the "non-lasted" skate boot. As mentioned above, this type of boot has conventionally also been known sometimes as the "molded" skate boot. Boots of this construction usually have a (relatively) rigid shell usually molded from a plastic or composite by any one of a number of conventional molding techniques. The shell provides the structure to the boot as it is (usually directly) molded into a three-dimensional shape during its manufacture, it is (usually) the mold that gives the shell its three-dimensional shape, and it is the shell's three-dimensional shape that will define the three-dimensional shape of the boot itself. The shell also carries most of the forces and stresses exerted on the boot while skating. The remainder of the skate boot components are affixed, either directly or indirectly, to the shell.

As is the case with lasted skate boots, non-lasted skate boots also have their disadvantages, which are themselves generally well known in the art. Specifically, non-lasted skate boots tend to be made out of relatively rigid plastics or composites that do not offer much flexibility (particularly in the ankle area), and are considered to be overly rigid in many cases by wearers. Moreover, given the amount of material required to make the shell have sufficient structural strength, non-lasted skate boots tend to be (relatively) much heavier than lasted skate boots (which is a significant disadvantage). Finally because of the rigidity of the skate boot, it is more difficult for the boots to break in and conform better to the foot of a wearer over time. Skate manufacturers have tried to ameliorate some of these disadvantages, again with more or less success over time.

In summary though, notwithstanding the advances in skate boot technology that have been made over time, no conventional skate boot, be it lasted nor non-lasted, is "perfect" nor its without drawbacks, and there is currently room for improvement in skate boot manufacturing technology.

SUMMARY OF THE INVENTION

Thus, it is an object of the present invention to ameliorate at least some of the inconveniences present in the prior art.

It is also an object of the present invention to provide an improved non-lasted skate boot as compared with at least some of the prior art.

Therefore, in one aspect, as embodied and broadly described herein, the present invention provides a skate boot comprising a non-lasted boot shell. The shell has a first non-lasted three-dimensional sub-shell and a second non-lasted three-dimensional sub-shell. The second sub-shell is interior to and adjoins the first sub-shell. The first sub-shell comprises a first material having a first density and the second sub-shell comprises a second material having a second density. The second density is less than the first density. The shell is shaped so as to have a heel portion, an ankle portion, a lateral portion, a medial portion, and a sole portion. A ground-engaging assembly is disposed on an underside of the skate boot.

The first material has a first stiffness and the second material has a second stiffness. In some embodiments the first stiffness is less than the second stiffness, while in other embodiments the first stiffness is greater than the second stiffness. The choice of the actual stiffness of each of the materials and of the stiffness difference between them depends on the desired final characteristics of the skate including the desired overall stiffness of the skate.

In the context of the present application the term "shell" means a boot structure that carries all or a major portion of the torsional and bending stresses applied to the boot. However, "shell" does not require that that outer sub-shell be the outermost structure of the skate boot (although this is the case in some embodiments), as additional elements or structures may be disposed on or outward of that outer sub-shell. The term "non-lasted" means that the shell or sub-shell (as the case may be) is directly formed into a three-dimensional shape at the time of initial formation (as opposed to being formed flat and being later bent into a three dimensional shape, around a last for example). The term "non-lasted" does not exclude, however, any kind of operation or working being performed on non-lasted shell or sub-shell after it has been initially formed to change or alter the shape into which it was initially formed. In addition, the term "non-lasted shell" does not require that the entire shell be non-lasted, for the purposes of the present specification, a shell is non-lasted if the various sub-shells of which it is formed are all non-lasted (other add-on components may be formed in other manners).

The present inventors have realized that by using a shell of the present invention, it is possible to manufacture skate boot shells wherein the component sub-shells thereof synergistically interact with one another to produce a shell having enhanced characteristics over both (i) any of the sub-shells taken separately and (ii) single-material shell made from one of the materials of which one of the sub-shells is made. Thus, in certain embodiments for example, it is possible to create boot shells that have sufficient structural strength to serve their intended function, yet that are lighter than conventional non-lasted skate boots. Further, without wishing to be bound by any particular theory, it appears that in some embodiments by locating a relatively dense one of the sub-shells away from the foot of the wear and by placing a lower density material in between that dense sub-shell and foot, a skate boot with good characteristics (including, in some embodiments, characteristics approaching those of good lasted skate boots) can be obtained. Also, again without wishing to be bound by any particular theory, in some embodiments shells of the present invention, by having an integral sole portion, appear to offer better fit with the ground-engaging element assembly and to provide for better energy transfer to the skating surface.

Further, some embodiments of the present invention can have certain advantages over prior art lasted-skate boots. Because the sub-shells are non-lastedly formed having a predetermined three-dimensional shape (i.e. are generally directly formed into that predetermined three-dimensional shape—with or without minor working after formation), the final shape of the boot shell (and thus the boot itself) can be determined and reproduced with accuracy. This can improve the quality and consistency of the production process, as (but for errors in the production process) each of the skate boots made by this process can be the same. This can also allow for a more precise design and determination of the final shape of the boot shell in order to ensure that the skate boot has desired characteristics and shape (for example, to better anatomically conform to the shape of the foot and ankle). Such design at a micro level is generally not possible with lasted skate boots. Furthermore, the process by which the present skate boots are manufactured has less room for error and does not require craftsmen with the high degree of skill level required with lasted booted manufacturing processes, and therefore may be simpler, more efficient and less expensive.

In addition some embodiments of the present invention have certain advantages over prior art non-lasted skate boots. Having a shell construction of the present invention, in certain embodiments the present skate boots can be much lighter than prior art non-lasted skate boots and therefore can be unlikely to suffer the drawback of being found to be too heavy by their wearers. Further, by having a inner sub-shell being less dense than the first outer sub-shell in some embodiments, the present skate boots can provide better fit and comfort to a wearer than conventional non-lasted skate boots. They also can be more flexible and can have a reduced break-in time.

Preferably, in the context of the present invention, the second (and in a dual sub-shell—the inner) material is a foam, and more preferably it is a thermoplastic foam. Foams are highly preferred as they are relatively inexpensive, relatively easy to work with, are lightweight, have sufficient strength, provide good impact absorption, and are generally heat formable. Thermoplastic foams provide the additional benefit that they may be reheated after initial formation and reshaped to better conform to the foot of a person who will use the skate, reducing the "break-in" time. (This thermoforming may be accomplished using any one of a number of conventional techniques.) Other possible second materials are non-foam materials having void spaces therein. A non-limiting list of suitable second materials includes: expanded polypropylene (EPP), expanded polystyrene (EPS), a latex foam, a vinyl foam, cork, 3D thermoplastic or composite meshes having a honeycomb structure, and balsa wood, etc., and combinations thereof.

Preferably, the first (and in a dual sub-shell the outer) material is a plastic. Plastics are preferred as they are relatively inexpensive, relatively easy to work with, and have sufficient strength and rigidity. Thermoplastics are preferred. A non-limiting list of suitable first materials includes: high density polyethylene (HDPE), polypropylene (PP), ionomers such as Surlyn®, polycarbonates (PC) such as Lexan®, polyethylene terephthalate (PET), acrylonitrile butadiene styrene (ABS), thermoplastic elastomers (TPE's) such as polyether block amide (for example, Pebax®, composites (including fibreglass), resin impregnated textiles, textiles, etc., and combinations thereof (Surlyn® thermoplastic resins (E.I. DuPont de Nemours and Company; Wilmington, Del., U.S.A.) are ionomer resins created from acid copolymers wherein acid neutralization results in the formation of ion clusters. Copolymers used in the formation of Surlyn® resin can include ethylene acid copolymers such as ethylene/methacrylic acid.)

For ornamental or other reasons, in some embodiments, the first material may also be or include a graphical element laminate as described in U.S. provisional patent application Ser. No. 61/177,621, filed May 12, 2009, entitled "Graphical Element Laminate for Use in Forming a Skate Boot Quarter", and assigned to the assignee of the present application, which is incorporated herein by reference in its entirety. For example, such a graphical element laminate may include: a base layer having inner and outer sides; a first thermoplastic layer laminated on the base layer outer side, the first thermoplastic layer having inner and outer sides; and a graphical element printed on the inner side of the first thermoplastic layer, at least a portion of the first thermoplastic layer overlying the graphical element being transparent or translucent such that when the laminate forms part of the skate boot, the graphical element being visible trough the first thermoplastic layer from an exterior of the skate boot. The base layer may also include a design element also visible from the exterior of the skate boot. Optionally, a second thermoplastic layer may interposed between the first thermoplastic layer and the base layer. In such cases, the graphical element may be, or may also be, printed on the second thermoplastic layer.

Further, in some embodiments of the present invention, and particularly in those where the outermost sub-shell of the boot shell forms the outside surface of the skate boot, the outer surface of the outermost sub-shell (in addition to or in place of being or having a graphical element laminate as described above) may be textured, colored or otherwise decorated to provide ornamentation to the skate.

It is also possible in some embodiments to add additional material to the interior of the shell, be it for structural, reinforcement, ornamental or other purposes. Such materials can be similar to any one of the sub-shells or different from all of them, depending on their purpose. As an example, Surlyn® strips may be added to the inner surface of the inner sub-shell to provide for additional reinforcement.

Further, with the combination of a plastic first material and a foam second material, some embodiments of the invention can provide better protection from impacts to wearers of the skate in that, without wishing to be bound by any particular theory, it appears that the plastic first sub-shell will distribute energy of the impact and that the foam second sub-shell will absorb the distributed energy of the impact.

Preferably, the first sub-shell and the second sub-shell are fastenerlessly bonded to one another. I.e. they are bonded together as the materials of which they are made are directly bonded to one another without the intermediary of a fastener. Whether or not this is the case can depend on the materials of which the sub-shells are constructed and the method of manufacture chosen. Alternatively they may be fastenerlessly bonded together via bonding techniques such as heat fusion or high-frequency bonding. Where the first sub-shell and the second sub-shell are not fastenerlessly bonded together, they may be joined to one another via at least one of a chemical fastener and a mechanical fastener. Suitable chemical fasteners include any adhesive, glues, etc. (whether, for example, light-activated, heat-activated, solvent-based, water-based, etc.) that are compatible with both the materials being fastened and the manufacturing process. Suitable mechanical fasteners include: stitching, clips, rivets, staples, tacks, surface textures, interlocking elements (whether part of the sub-shells themselves or added thereto), etc.

Preferably the first sub-shell has a contoured inner surface and the second sub-shell has a contoured outer surface complimentary with the inner surface of the first sub-shell. In this manner, the two sub-shells will register very well together leaving little or no undesired space between them. In addition, the contoured surfaces may be constructed so as to reduce (or prevent) undesired movement of the two shells with respect to one another during the manufacturing process to assist in improving quality and consistency of the process. Further, in addition to or in place of being complimentary, the registering surfaces of the sub-shells may have interlocking elements (e.g. ribs, grooves, etc.) that mate with one another when the sub-shells are properly placed together. These interlocking elements may serve, for example, as alignment elements (to ensure that the sub-shells are properly placed together) and/or fasteners (to prevent the sub-shells from coming apart).

Preferably, the first sub-shell has an inner surface and the second sub-shell has an outer surface, the inner surface covering an entirety of the outer surface. In other embodiments, the inner surface covers less than an entirety of the outer surface.

In some embodiments at least one of the first sub-shell and the second sub-shell is of variable thickness. In other embodiments more than one, or even all of the sub-shells are of variable thickness. By varying the thickness of the sub-shells the physical properties of the shell may be varied. For example, if reinforcement of a particular area is desired (as may be the case, for instance, when that area of the boot will undergo repeated cyclical stresses), the first sub-shell may be locally thickened in that area. As another example, if additional impact protection is desired in a particular area, the second sub-shell may be locally thickened in that area. The converse is also true, i.e. that the thickness in particular areas may be reduced as is required as well, where, for example, more flexibility and/or less protection is required. Variable thickness of any of the sub-shells is not required however, and embodiments of the invention have sub-shells that are all of constant thickness.

Reinforcement of certain areas of the shell (or sub-shells thereof) may also be accomplished by designing those areas to have a shape that has this effect. Examples include shaping structures such as ribs, grooves, or dimples (such as on a golf ball) or others that have that effect of locally altering the structure (such as by adding a honeycomb structure) so as to result in a reinforcing effect. These may be in addition to or in place of altering the thickness in that area.

Additionally, a reinforcing element or elements may be associated with the skate boot for reinforcement. Such elements are not limited to being associated only with the shell. They include, but are not limited to, heel counters, ankle supports, shanks, plates or rods in the sole or elsewhere, and are well known in the art. These elements may, for example, thus be additional pieces of (relatively) rigid plastics, composites, metals, woods, foams, textiles, etc. associated with the area that needs reinforcement. They may be in one of the sub-shells of the shell, in between the various sub-shells of the shell, on the outside or inside of the shell, or located elsewhere on the boot.

In certain embodiments the boot shell or any one or all of the sub-shells (depending on the exact construction of the embodiment in question) have a left portion and a right portion that have been non-lastedly formed separately from one another in three-dimensions and then have been later joined together to form the desired sub-shell structure. Thus, for example, where the shell has two sub-shells, each of the sub-shells may be split down the longitudinal centerline of the sub-shell forming two halves. The halves can then be joined via any suitable conventional technique (e.g. bonding, fusing, gluing, stitching, etc.) during the manufacturing process. Alternatively, in some embodiments only one of the sub-shells is manufactured in halves (or portions) and is later joined together, while the other(s) are manufactured whole. All such possible combinations are within the scope of the present invention. Various ones of embodiments of the invention of this type may be desirable in certain instances, as, for example, they can be easier to manufacture in certain circumstances (e.g. when one or more the sub-shells has an integrated toe cap portion).

An important aspect of some embodiments of the present invention is that they allow for the creation of a skate boot shell (and thus a skate itself) that is highly customizable. Thus, taking a dual sub-shell shell for example, it is possible to design a set of various interchangeable outer sub-shells, each one having its own distinct characteristics (as at least one of the properties thereof (for example one of those described hereinabove) varies between members of the set), and also a set of various interchangeable inner sub-shells, each one having its own distinct characteristics (as at least one of the properties thereof (for example one of those described hereinabove) varies between members of the set), and allowing a person (be it a consumer or a retailer for example) to choose the particular ones of the sets that they wish to have in their skate (or skates), allowing them to customize a skate (or skates) to their desired specification and having their desired characteristics. Further, owing to the synergistic effect between the various sub-shells when combined to form a shell of the present invention, in this manner, in some embodiments, this allows for the creation of a set of skates having a relatively wide range of characteristics in a relatively simple and efficient manner that can be accessible to consumers at a relatively inexpensive price. In this respect, having shells of more than two sub-shells may increase these benefits.

It should be understood that although many of the examples and terminology used in the present specification explicitly or implicitly refer to a shell having a simple dual sub-shell structure, the present invention is not so limited. Shells having more than two sub-shell structures are within the scope of the present invention. Thus for example, it is possible to add a third sub-shell interior to and adjoining the second sub-shell. The characteristics of the third sub-shell can depend on the overall desired characteristics of the skate. Depending on the manufacturing process and design characteristics, the third sub-shell can be different from the other two sub-shells or can be the same (as the first sub-shell for example). As an example, it is possible to have an injection molded EPP second sub-shell that is completely coated by Surlyn® through a dipping process. Thus, the resulting shell would have a first and a third Surlyn® sub-shell that are very similar if not identical to one another and that would be connected to one another. Alternatively, in a modified example, the Surlyn® sub-shells could be created through a vacuum molding process, yielding a shell wherein the first and third sub-shells would not necessarily be connected to one another.

Preferably the skate boot further comprises: a boot toe cap connected to the boot shell for protecting the toes of a wearer of the skate boot; a boot tongue connected to the toe cap; a boot facing connected to the lateral and material portions of the boot shell; a boot liner disposed within the boot shell. Examples of these components are conventional skate components whose manufacture is readily within one skilled in the art of skate boot construction.

In some embodiments, the facing is more flexible than the skate boot shell, as this can provide the skate boot with the required overall flexibility while having a relatively rigid boot shell. The facing may be given the desired flexibility, for example, through its materials, construction, or method of attachment to the skate (or some combination thereof). A suitable example of such a facing is one made of an expanse of ethyl-vinyl acetate (EVA) that is stitched to the shell only near to one edge thereof, leaving the majority of the facing (including the eyelets) neither overlying nor underlying shell and thus free to stretch, move, etc.

In some embodiments, at least one of the sub-shells includes a toe cap portion (in addition to its other portions). In some embodiments, all of the sub-shells include a toe cap portion. In either manner, in some embodiments of the present invention, the boot shell includes a toe cap portion.

Preferably the skate boot is an ice skate boot and the ground-engaging assembly includes a blade adapted for skating on ice.

In another aspect, as embodied and broadly described herein, the present invention provides, a method of manufacturing a non-lasted skate boot shell, the shell having a first non-lasted three-dimensional sub-shell and a second non-lasted three-dimensional sub-shell, the shell being shaped so as to have a heel portion, an ankle portion, a lateral portion, a medial portion, and a sole portion, the method comprising:

(i) forming the first non-lasted three-dimensional sub-shell, the first sub-shell having an inner surface;
(ii) forming the second non-lasted three-dimensional sub-shell, separately from the first shell sub-shell, the second sub-shell having an outer surface registerable with the inner surface of the first sub-shell;
(iii) placing the second sub-shell within an interior of the first sub-shell such that the outer surface of the second sub-shell registers with the inner surface of the first sub-shell; and
(iv) securing the second sub-shell to the first sub-shell.

In still another aspect, as embodied and broadly described herein, the present invention provides a method of manufacturing a non-lasted skate boot shell, the shell having a first non-lasted three-dimensional sub-shell and a second non-lasted three-dimensional sub-shell, the shell being shaped so as to have a heel portion, an ankle portion, a lateral portion, a medial portion, and a sole portion, the method comprising:

(i) non-lastedly forming the first three-dimensional sub-shell, the first sub-shell having an inner surface; and
(ii) non-lastedly forming the second three-dimensional sub-shell within and secured to the first sub-shell, the second sub-shell having an outer surface registering with the inner surface of the first sub-shell.

In yet another aspect, as embodied and broadly described herein, the present invention provides a method of manufacturing a non-lasted skate boot shell, the shell having a first non-lasted three-dimensional sub-shell and a second non-lasted three-dimensional sub-shell, the shell being shaped so as to have a heel portion, an ankle portion, a lateral portion, a medial portion, and a sole portion, the method comprising:

(i) non-lastedly forming the second three-dimensional sub-shell, the second sub-shell having an outer surface; and
(ii) non-lastedly forming the first three-dimensional sub-shell around and secured to the second sub-shell, the first sub-shell having an inner surface registering with the outer surface of the second sub-shell.

Sub-shells of the present invention may be non-lastedly formed in three dimensions by one or more of any number of conventional molding methods appropriate for the materials of which the sub-shells are made and to the final assembly process. For example, some possible methods include vacuum molding (single or multiple layer), injection molding and over molding. It should be understood, however, that the present invention is not limited to molding (nor molded sub-shells). Other non-lasted methods of forming include, for example, spray build-up, dipping, brushing, and wet lay-up (of resins or composites for example). The actual particular methods used will vary from embodiment to embodiment depending on any number of conventional factors and considerations.

As an example, where it is desired to have a dual sub-shell shell with the inner sub-shell being EPP and the outer sub-shell being Surlyn®, the inner EPP sub-shell can be formed first in three dimensions through as conventional injection molding technique, and the outer Surlyn® sub-shell can then be formed and secured thereto by being conventionally vacuum formed around the EPP sub-shell. Alternatively, in another example, both the inner EPP sub-shell and the outer Surlyn® sub-shell can be separately formed (the order of forming of which is unimportant) and then later secured together with a suitable adhesive.

In still yet another aspect, as embodied and broadly described herein, the present invention provides a skate boot having a skate boot shell manufactured according to any one of the methods set forth hereinabove.

In a further aspect, as embodied and broadly described herein, the present invention provides a method of assembling a non-lasted skate boot shell, the shell having a first non-lasted three-dimensional sub-shell and a second non-lasted three-dimensional sub-shell, the shell being shaped so as to have a heel portion, an ankle portion, a lateral portion, a medial portion, and a sole portion, the method comprising:

(i) providing the first non-lasted three-dimensional sub-shell, the first sub-shell having an inner surface;

(ii) providing the second non-lasted three-dimensional sub-shell, the second sub-shell having an outer surface registering with the inner surface of the first sub-shell; and (iii) positioning the second sub-shell within the first sub-shell such that the outer surface of the second sub-shell registers with the inner surface of the first sub-shell.

Optionally, in a separate and later step, the first sub-shell and the second sub-shell can be secured to one another.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

It should be understood that examples used throughout the present specification are for illustrative purposes and as an aid to understanding. They are not intended to be limiting nor to define the present invention.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 1:
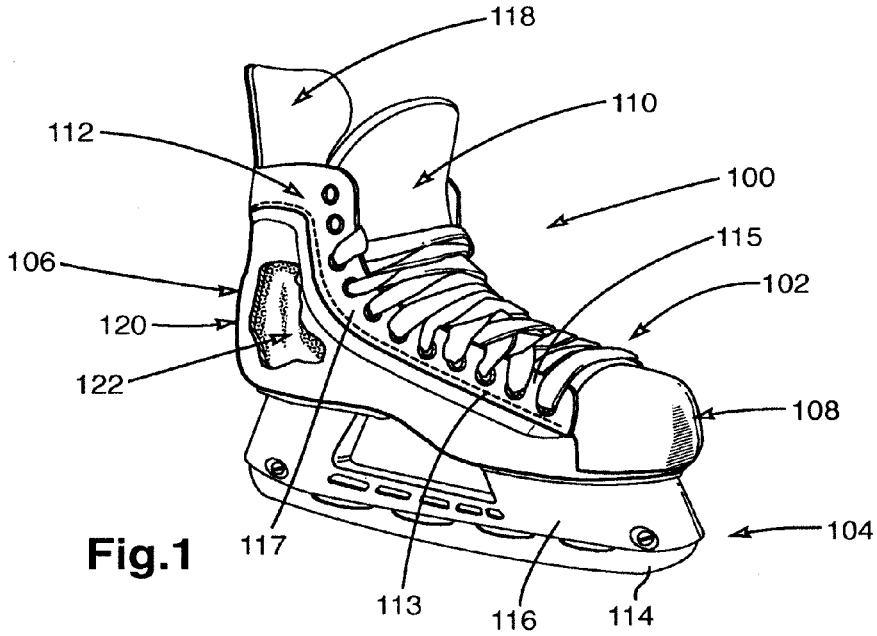
FIG. 1 is a right front perspective view of a right skate having a first embodiment of the present invention.

An embodiment of the invention, being an ice skate 100 (for the right foot), is shown in FIG. 1. (Other embodiments of the invention include, but are not limited to, left ice skates, and inline roller skates.) Skate 100 has a skate boot 102 and a skate blade assembly 104. Skate has a skate boot shell 106, which is shown with a cut-away to reveal the sub-shells 120, 122 thereof described in further detail below. Skate boot 102 also has a skate boot toe cap 108, a skate boot tongue 110, a skate boot liner 118, and skate boot facing 112. Skate blade assembly 104 has a skate blade 114 and a skate blade holder 116. The skate boot toe cap 108, skate boot tongue 110, skate boot liner 118, and skate blade assembly 104 and their various components are conventional, and their manufacture, assembly, and use are within the knowledge of one skilled in the art of skate design, and will not be described further herein.

Figure 2:
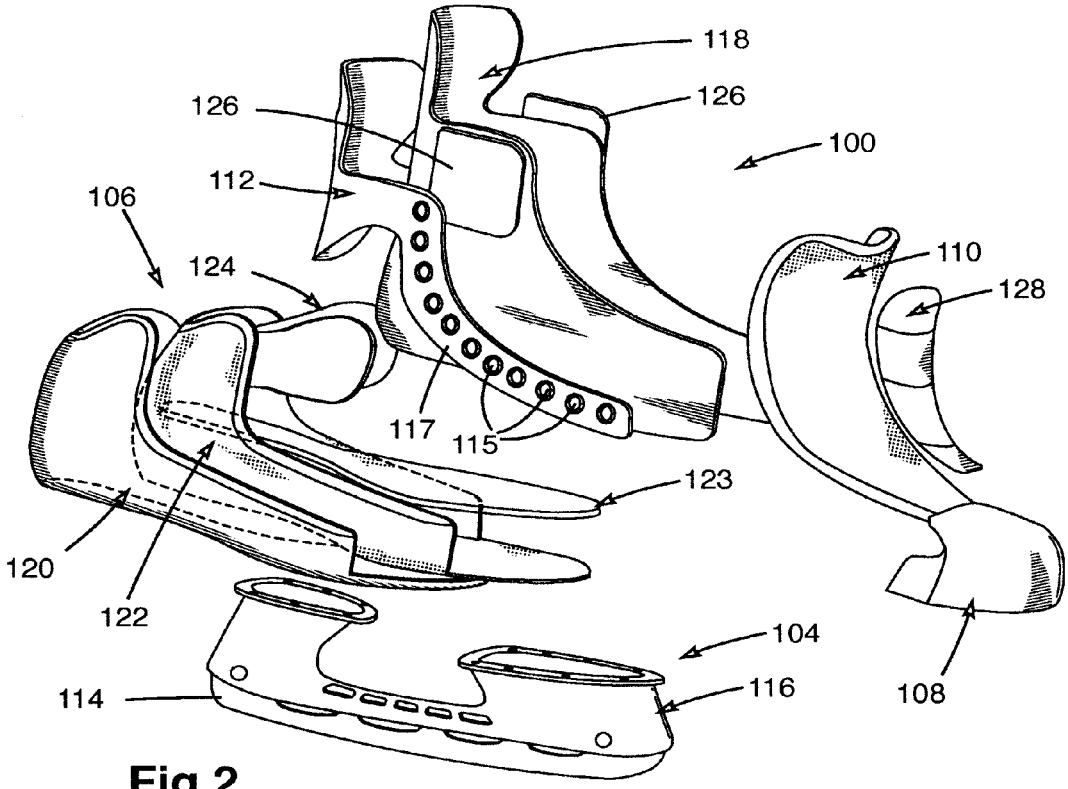
FIG. 2 is a right front perspective exploded view of the skate of FIG. 1.

FIG. 2 shows an exploded view of the ice skate 100 of FIG. 1, to allow for a better understanding of the various components thereof. Referring particularly to skate boot shell 106, it will be seen that in this embodiment, skate boot shell 106 has two sub-shells, an outer sub-shell 120 and an inner sub-shell 122. Skate 100 also has an associated reinforcing element 124 (being a conventional molded plastic ankle protector), a conventional lace bite protector 128, and a conventional mid-sole 123 (for securing the skate blade assembly 104 to the skate boot 102). Skate liner 118 also has conventional foam ankle padding 126.

Figure 3:
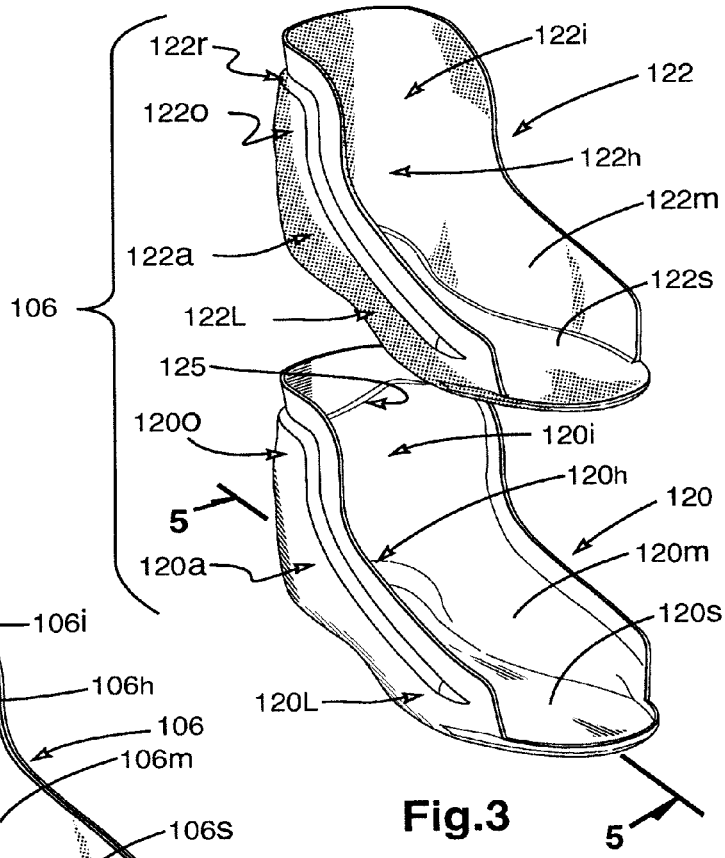
FIG. 3 is a right front perspective exploded view of the skate boot shell of the embodiment of the present invention incorporated into the skate of FIG. 1.

FIG. 3 shows an exploded view of the boot shell 106, showing the two sub-shells, outer sub-shell 120 and inner sub-shell 122. Each of outer sub-shell 120 and inner sub-shell 122 have a three-dimensional shape having a heel portion **120*h* and 122*h* (respectively), an ankle portion 120*a* and 122*a***

(respectively), a lateral portion 120*l* and 122*l* (respectively), a medial portion 120*m* and 122*m* (respectively), and a sole portion 120*s* and 122*s* (respectively). Thus, referring to FIG. 4, the boot shell 106 itself, when assembled, has a three-dimensional shape having a heel portion 106*h*, an ankle portion 106*a*, a lateral portion 106*l*, a medial portion 106*m*, and a sole portion 106*s*.

Figure 6:
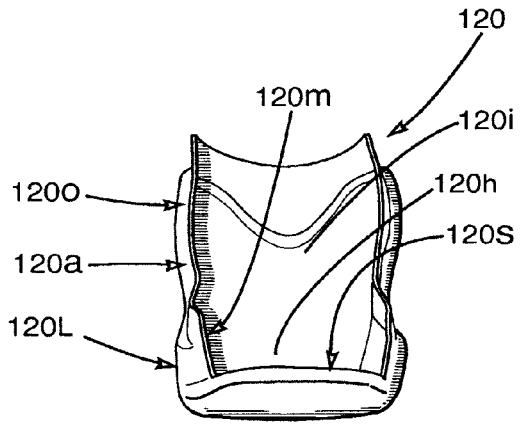
FIG. 6 is a front elevation view of the outer sub-shell of the shell of the embodiment of the present invention incorporated into the skate of FIG. 1.
Figure 8:
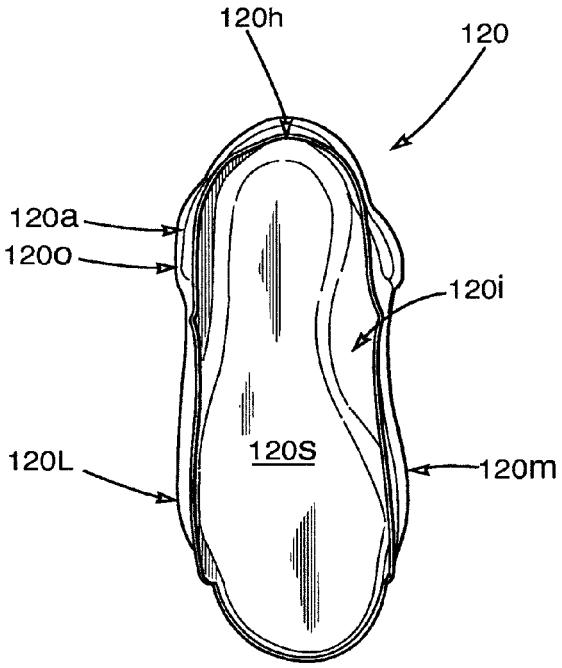
FIG. 8 is a top plan view of the outer sub-shell shown in FIG. 6.

Outer sub-shell 120 is a vacuum-molded three-dimensional structure made of SURLYN®, made via a conventional vacuum molding technique. Outer sub-shell 120 is three-dimensionally shaped (when molded) so as to (when incorporated into boot shell 106 and when boot shell 106 is incorporated into skate 100) conform well to the foot of a wearer during use of the skate 100. Various views of the three-dimensional shape of outer sub-shell 120 can be seen in FIGS. 6 and 8.

Figure 5:
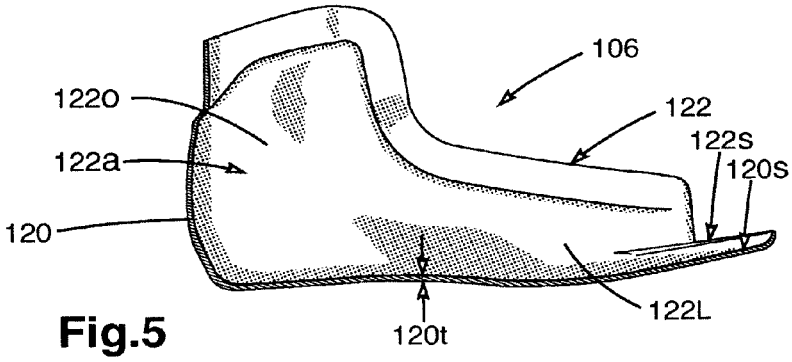
FIG. 5 is a cross-sectional view of the outer sub-shell of the shell of the embodiment of the present invention incorporated into the skate of FIG. 1 taken along the line 5-5 of FIG. 3 and a right side elevational view of the inner sub-shell of the shell of the embodiment of the present invention incorporated into the skate of FIG. 1, when the two are assembled into a shell.

Referring to FIG. 5, which shows outer sub-shell 120 in cross-section, the thickness 120*t* of the outer sub-shell 120 can vary from between about 0.1 mm to about 5 mm. Preferably, the thickness 120*t* is between about 0.5 mm to about 5 mm, and more preferably between about 1 mm to about 3 mm. The density of outer sub-shell 120 can vary between about 0.75 g/cm$^3$ and about 1.1 g/cm$^3$. Preferably, the density is between about 0.85 g/cm$^3$ and about 1.0 g/cm$^3$. More preferably, the density is between about 0.9 g/cm$^3$ to about 1.0 g/cm$^3$. Most preferably, the density is between about 0.95 g/cm$^3$ to about 0.98 g/cm$^3$.

Inner sub-shell 122 is an injection molded three-dimensional stricture made of EPP, made via a conventional injection technique (with resin being injected into and then being allowed to expand in the mold). Inner sub-shell 122 is shaped so as to (when incorporated into boot shell 106 and when boot shell 106 is incorporated into skate 100) conform well to the foot of a wearer during use of the skate 100. Various views of the three-dimensional shape of the inner sub-shell 122 can be seen in FIGS. 7 and 9, showing the assembled boot shell 106.

Although not shown, the thickness of the inner sub-shell 122 is generally constant in this embodiment (although it may vary in others). Preferably, the thickness of the inner sub-shell 122 is between about 1 mm to about 15 mm. More preferably, the thickness of the inner sub-shell 122 is between about 2 mm to about 10 mm. Still more preferably, the thickness of the inner sub-shell 122 is between about 4 mm to about 8 mm. Yet more preferably, the thickness of the inner sub-shell 122 is between about 5 mm to about 6 mm. Most preferably, the thickness of the inner sub-shell 122 is about 5.4 mm. The density of inner sub-shell 122 can vary between about 0.016 g/cm$^3$ (1 lb/ft$^3$) and about 0.32 g/cm$^3$ (20 lb/ft$^3$). Preferably, the density is between about 0.032 g/cm$^3$ (2 lb/ft$^3$) and about 0.16 g/cm$^3$ (10 lb/ft$^3$). More preferably, the density is between about 0.80 g/cm$^3$ (5 lb/ft$^3$) and about 0.95 g/cm$^3$(6 lb/ft$^3$). Most preferably, the density is about 0.83 g/cm$^3$ (5.2 lb/ft$^3$).

Referring to FIG. 3, inner sub-shell 122 has an outer surface 122*o* having a contoured three dimensional shape. Outer sub-shell 120 has an inner surface 120*i* having a contoured three dimensional shape. The contoured shapes of the outer surface 122*o* and the inner surface 120*i* are complimentary such that when the inner sub-shell 122 is placed within the outer sub-shell 120, the surfaces 122*o*, 120*i* register well in forming the boot shell 106. Further, as can be seen in the figures, both the outer sub-shell 120 and the inner sub-shell 122 are shaped so as to have ridges 120*r*, 122*r* (respectively) on their outer surfaces 120*o*, 122*o* (respectively) to provide reinforcement. The ridge 122*r* on the outer surface 122*o* of the inner sub-shell 122 is complimentary with a ridge-receiving shape 125 on the inner surface 120*i* of the outer-shell 120, such that they register when the boot shell is formed; and, together with the ridge 120*r* of the outer sub-shell, form boot shell reinforcement ridge 106*r*.

Figure 4:
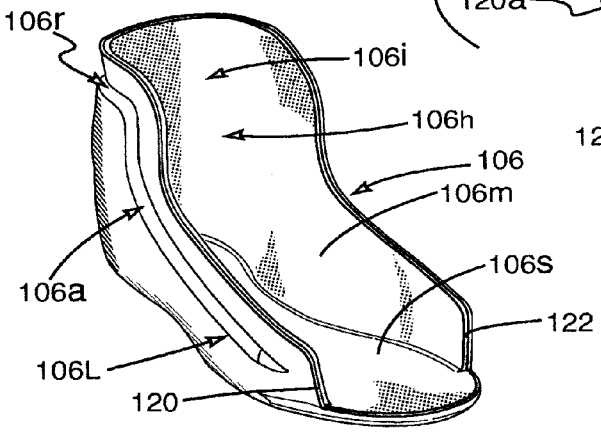
FIG. 4 is a right front perspective view of the shell of the embodiment of the present invention incorporated into the skate of FIG. 1.
Figure 7:
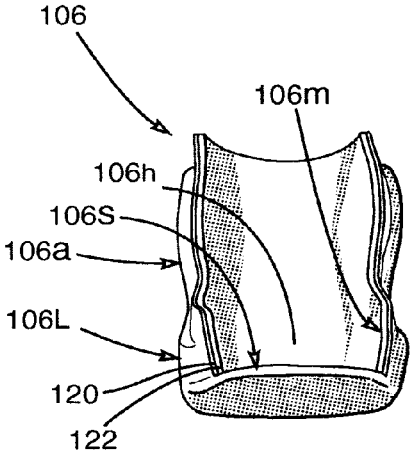
FIG. 7 is a front elevation view of the shell of the embodiment of the present invention incorporated into the skate of FIG. 1.
Figure 9:
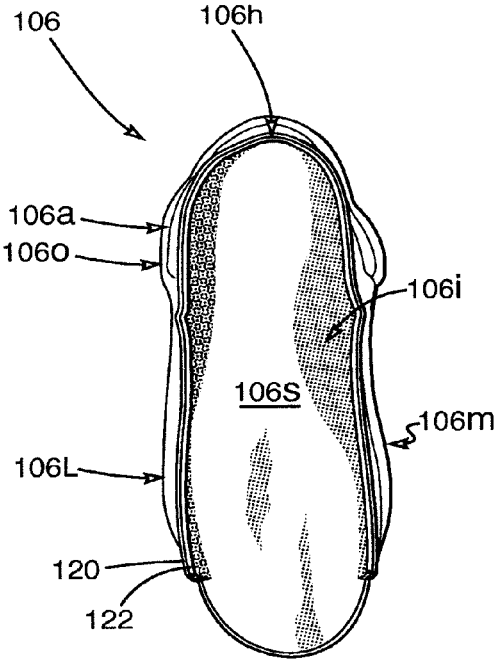
FIG. 9 is a top plan view of the shell shown in FIG. 7.

Referring to FIGS. 4, 7 and 9, when the inner sub-shell 122 is placed within the outer sub-shell 120 to form boot shell 106, in this embodiment, the entirety of the outer surface 122*o* of the inner sub-shell 122 is covered by the inner surface 120*i* of the outer sub-shell 120.

Boot shell 106 is assembled by first coating the outer surface 122*o* of inner sub-shell 122 with a conventional adhesive and then placing inner sub-shell 122 within outer sub-shell 120.

Once boot shell 106 is assembled, skate 100 is assembled in a conventional manner with the exception of facing 112 (which is made of EVA). In skate 100, (in contrast with conventional facings) facing 112 is secured to boot shell 106 via stitching 113 only along the bottom portion of the facing. Thus, the majority of the body 117 of facing 112 (including the eyelets 115) neither underlies nor overlies the boot shell 106 and it is not secured to the boot shell. This leaves the majority of the body 117 of facing 112 free to stretch, move, contract, etc. during use of the skate 100, adding to the skate's flexibility.

Figure 10:
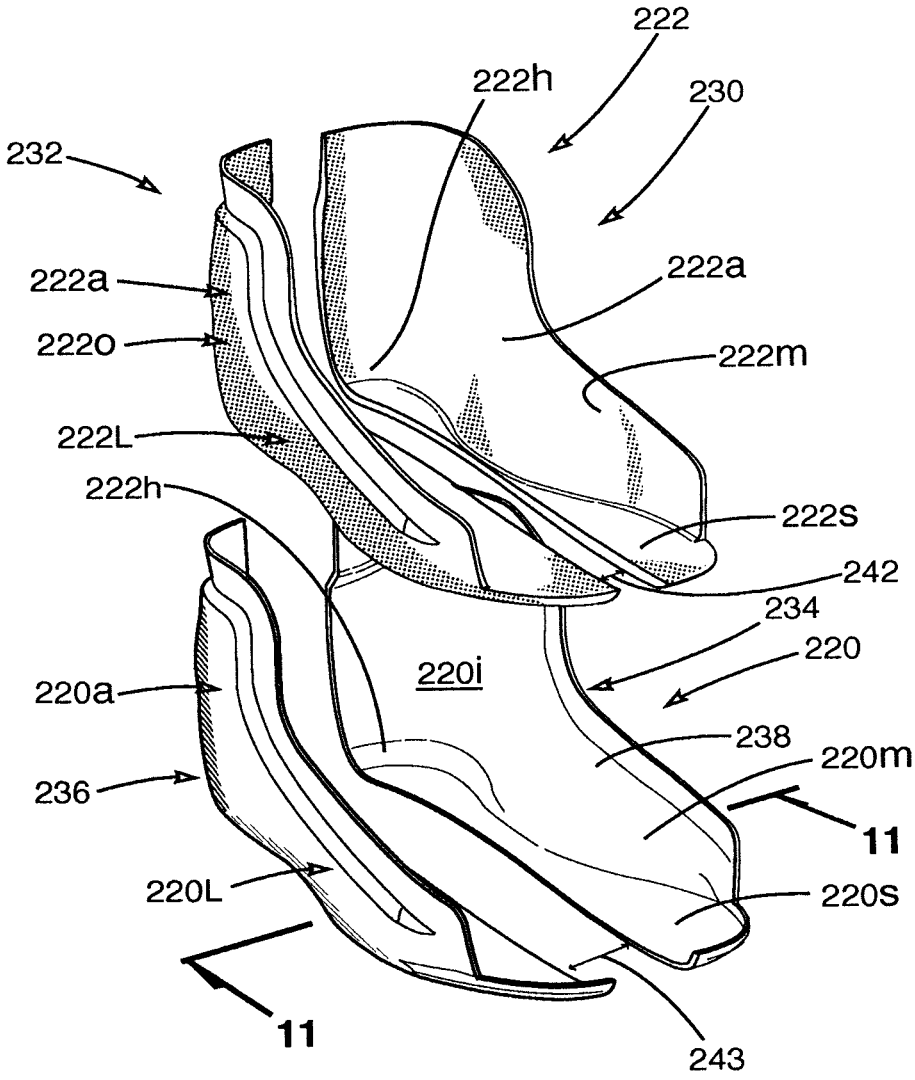
FIG. 10 is a right front perspective view of a shell being a second embodiment of the present invention.
Figure 11:
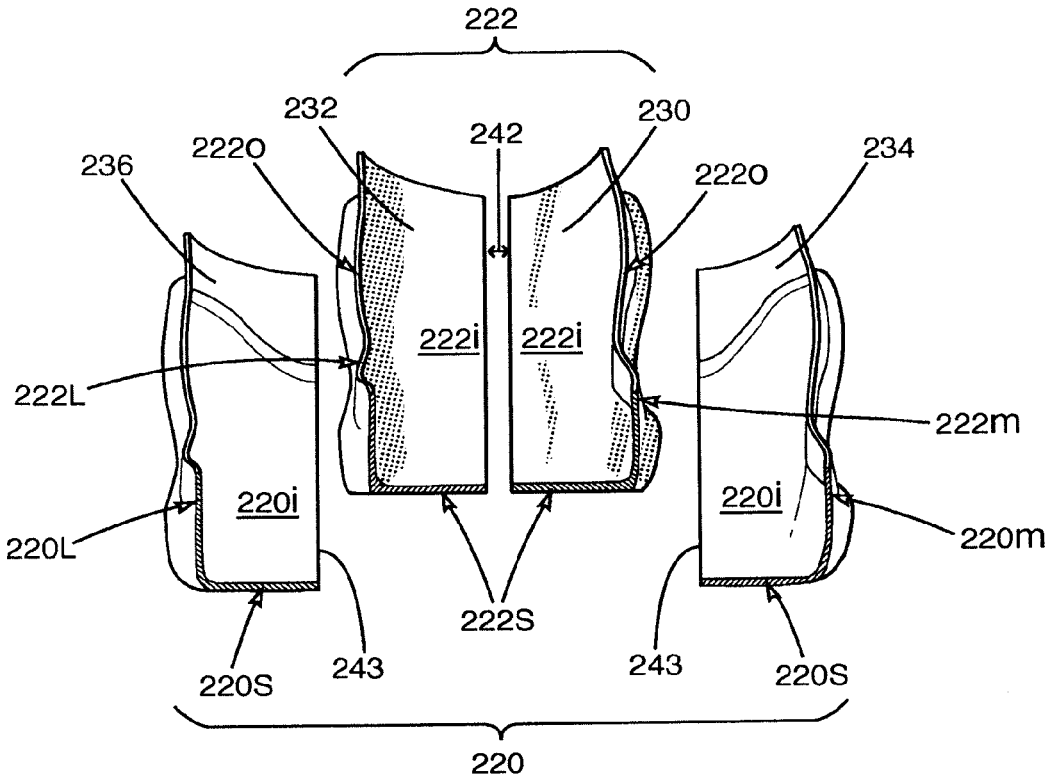
FIG. 11 is a cross-sectional exploded view of the shell of FIG. 10 taken along the line 11-11 in FIG. 10.

Referring now to FIGS. 10 and 11, there is shown a second embodiment of the present invention, being skate boot shell 206 (for a right skate—the full skate has been omitted for ease of illustration since it is otherwise conventional), which is similar to the skate boot shell 206 with some exceptions. In this embodiment each of the outer sub-shell 220 and inner sub-shell 222 are formed as two halves. Thus, outer sub-shell 220 has a right half 236 and a left half 234. Similarly inner sub-shell 222 has a right half 232 and a left half 230.

Outer sub-shell 220 has a heel portion 220*h*, a part of which is located on right half 236 and a part of which is located on left half 234. Outer sub-shell 220 also has an ankle portion 220*a*, a part of which is located on right half 236 and a part of which is located on left half 234. Outer sub-shell 220 also has a medial portion 220*m* located on the left half 234 and a lateral portion 220*l* located on the right half 236. Outer sub-shell 220 also has a sole portion 220*s*, a part of which is located on right half 236 and a part of which is located on left half 234.

Inner sub-shell 222 has a heel portion 222*h*, a part of which is located on right half 232 and a part of which is located on left half 230. Inner sub-shell 222 also has an ankle portion 222*a*, a part of which is located on right half 232 and a part of which is located on left half 230. Inner sub-shell 222 also has a medial portion 222*m* located on the left half 230 and a lateral portion 222*l* located on the right half 232. Inner sub-shell 222 also has a sole portion 222*s*, a part of which is located on right half 232 and a part of which is located on left half 230.

Inner sub-shell 222 has an outer surface 222*o* (split across its left half 230 and its right half 232). Outer sub-shell 220 has an inner surface 220*i* (split across its left half 234 and its right half 236). The outer surface 222*o* of the inner sub-shell 220 is complimentary with the inner surface 220*i* of the outer sub-shell 220 such that the two register well when the sub-shell halves 230, 232 and 234, 236 are fanned into a whole sub-shell 222 and 220 (respectively) and the resultant sub-shells 220, 220 are assembled into boot shell 206.

Figure 12:
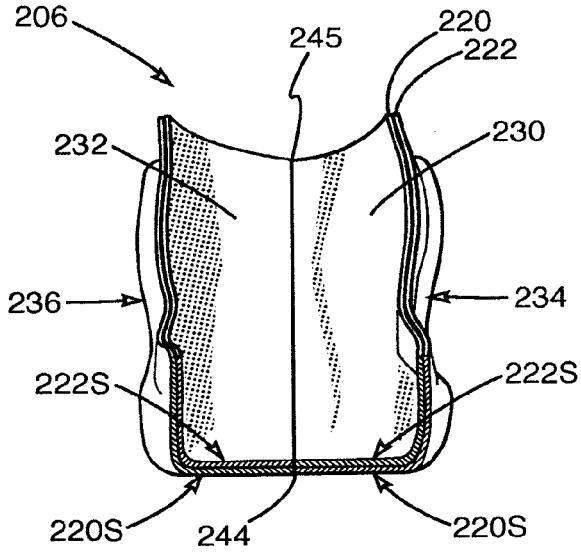
FIG. 12 is a cross-sectional view of the shell of FIG. 10 taken along the line 11-11 in FIG. 10 when the shell has been assembled.

Outer sub-shell halves 234, 236 are each a vacuum-molded three-dimensional structure made of SURLYN®, made via a conventional vacuum molding technique. Once manufactured, outer sub-shell halves 234, 236 are secured together at surfaces 243 via any suitable conventional technique (e.g. bonding, fastening, stitching etc.) to form joint 244 (in FIG. 12) and thus outer sub-shell 220 (which is otherwise similar to outer sub-shell 120 of the first embodiment, skate 100). Once manufactured, inner sub-shell halves 230, 232 are secured together at surfaces 242 via any suitable conventional technique (e.g. bonding, fastening, stitching, etc.) to form joint 245 (in FIG. 12) and thus inner sub-shell 222 (which is otherwise similar to inner sub-shell 220 of the first embodiment, skate 100).

Boot shell 206 is then assembled as is described above in relation to the first embodiment, skate 100.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

The invention claimed is:

1. A skate boot comprising:

a skate boot having a shell, the shell having:

a first non-lasted three-dimensional sub-shell, the first sub-shell including a first material having a first density, the first sub-shell having a shape defining a first heel portion, a first ankle portion extending from the first heel portion, a first lateral portion, a first medial portion, and a first sole portion connected to the first lateral, medial and heel portions;

a second molded three-dimensional sub-shell, the second sub-shell being interior to the first sub-shell, the second sub-shell being bonded to the first sub-shell either fastenerlessly or through a chemical fastener, the second sub-shell including a second material having a second density less than the first density, the second sub-shell having a monolithic shape defining a second heel portion, a second ankle portion extending from the second heel portion, a second lateral portion, a second medial portion, and a second sole portion integrally connected with the second lateral, medial and heel portions; and a ground-engaging assembly disposed on an underside of the skate boot.

2. A skate as recited in claim 1, wherein an outer surface of the second sub-shell is directly connected to an inner surface of the first sub-shell.

3. A skate as recited in claim 1, wherein the first material has a first stiffness and the second material has a second stiffness, the second stiffness being less than the first stiffness.

4. A skate as recited in claim 1, wherein the second material is a EPP foam.

5. A skate as a recited in claim 1, wherein the second material is a foam.

6. A skate as recited in claim 5, wherein the first sub-shell and the second sub-shell are joined to one another via at least one of a chemical fastener and a mechanical fastener.

7. A skate as recited in claim 5, wherein the first sub-shell and the second sub-shell are bonded to one another with adhesive.

8. A skate as recited in claim 5, wherein the first sub-shell has a contoured inner surface and the second sub-shell has a contoured outer surface complimentary with the inner surface of the first sub-shell.

9. A skate as recited in claim 1, wherein the first sub-shell is ornamented.

10. A skate as recited in claim 5, wherein the first sub-shell has an inner surface and the second sub-shell has an outer surface, the inner surface covering an entirety of the outer surface.

11. A skate as recited in claim 1, wherein the second sub-shell is of variable thickness.

12. A skate as recited in claim 1, wherein at least one of the first sub-shell and the second sub-shell is of a shape in at least one portion of the shell to provide reinforcement in that portion.

13. A skate as recited in claim 1, further comprising a third sub-shell interior to and adjoining the first sub-shell.

14. A skate as recited in claim 5, wherein the first material is a plastic or a composite material.

15. A skate as recited in claim 1, wherein the first material is a plastic and the second material is a thermoplastic foam.

16. A skate as recited in claim 1, further comprising:

a toe cap connected to the shell for protecting toes of a wearer of the skate;

a tongue connected to the toe cap;

a facing connected to the lateral and medial portions of the shell;

a liner disposed within the shell.

17. A skate as recited in claim 16, wherein the skate boot is an ice skate and the ground-engaging assembly includes a blade adapted for skating on ice.

18. A skate as recited in claim 16, wherein the facing is more flexible than the skate shell.

19. A method of manufacturing a non-lasted skate boot shell, the method comprising:

(i) forming a first three-dimensional sub-shell without using a last including forming a first heel portion, a first ankle portion extending from the first heel portion, a first lateral portion, a first medial portion, and a first sole portion connected to the first lateral, medial and heel portions, the first sub-shell having an inner surface;

(ii) molding a second three-dimensional sub-shell, separately from the first sub-shell, including forming a second heel portion, a second ankle portion extending from the second heel portion, a second lateral portion, a second medial portion, and a second sole portion integrally connected with the second lateral, medial and heel portions, the second sub-shell having an outer surface registerable with the inner surface of the first sub-shell;

(iii) placing the second sub-shell within an interior of the first sub-shell such that the outer surface of the second sub-shell registers with the inner surface of the first sub-shell; and (iv) securing the second sub-shell to the first sub-shell either fastenerlessly or through a chemical fastener.

20. A method of manufacturing a non-lasted skate boot shell as recited in claim 19, wherein the first sub-shell is formed of a first material having a first density and the second sub-shell is formed of a second material having a second density, the second density being less than the first density.

21. A method of manufacturing a non-lasted skate boot shell as recited in claim 20, wherein the second material is a foam.

22. A skate having a skate boot with non-lasted skate boot shell manufactured according to the method of claim 21.

23. A method of manufacturing a non-lasted skate boot shell as recited in claim 19, wherein the second sub-shell is injection molded.

24. A method of manufacturing a non-lasted skate boot shell as recited in claim 19, wherein the second sub-shell is directly secured to the first sub-shell.

25. A method of manufacturing a non-lasted skate boot shell as recited in claim 19, wherein the second material is EPP foam.

26. A method as recited in claim 21, wherein the first material is a plastic or a composite material.

27. A method as recited in claim 19, further comprising:

placing a third sub-shell within an interior of the second sub-shell such that an outer surface of the third sub-shell registers with an inner surface of the second sub-shell; and securing the third sub-shell to the second sub-shell.

* * * * *